US010415334B2

(12) United States Patent
Fripp

(10) Patent No.: US 10,415,334 B2
(45) Date of Patent: Sep. 17, 2019

(54) FLOW GUIDES FOR REGULATING PRESSURE CHANGE IN HYDRAULICALLY-ACTUATED DOWNHOLE TOOLS

(71) Applicant: Halliburton Energy Services, Inc., Houston, TX (US)

(72) Inventor: Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 430 days.

(21) Appl. No.: 14/910,096

(22) PCT Filed: Dec. 31, 2013

(86) PCT No.: PCT/US2013/078455

§ 371 (c)(1),
(2) Date: Feb. 4, 2016

(87) PCT Pub. No.: WO2015/102606

PCT Pub. Date: Jul. 9, 2015

(65) Prior Publication Data

US 2016/0194938 A1 Jul. 7, 2016

(51) Int. Cl.

| | |
|---|---|
| ***E21B 23/00*** | (2006.01) |
| ***E21B 33/128*** | (2006.01) |
| ***E21B 34/06*** | (2006.01) |
| ***E21B 23/06*** | (2006.01) |
| ***E21B 41/00*** | (2006.01) |

(52) U.S. Cl.

CPC ..... *E21B 23/00* (2013.01); *E21B 23/06* (2013.01); *E21B 33/1285* (2013.01); *E21B 34/063* (2013.01); *E21B 41/00* (2013.01)

(58) Field of Classification Search
None
See application file for complete search history.

(56) References Cited

U.S. PATENT DOCUMENTS

| | | | |
|---|---|---|---|
| 3,586,104 | A | 6/1971 | Hyde |
| 4,181,186 | A | 1/1980 | Blanton |
| 4,665,992 | A | 5/1987 | Franc |

(Continued)

FOREIGN PATENT DOCUMENTS

| | | |
|---|---|---|
| WO | 2013070219 | 5/2013 |

OTHER PUBLICATIONS

International Search Report and Written Opinion Issued in Corresponding Application No. PCT/US2013/078455, dated Sep. 24, 2014 (15 pages).

*Primary Examiner* — Nicole Coy
(74) *Attorney, Agent, or Firm* — Chamberlain Hrdlicka

(57) ABSTRACT

System, methods, and apparatuses for actuating a tool downhole in a wellbore are presented. In one instance, a system includes a hydraulic tool to generate a hydrostatic pressure in a first chamber using a hydraulic fluid. The hydraulic fluid the first chamber is transmitted through a fluid-flow path to a second chamber, which is at lower pressure. The fluid-flow path contains at least one fluid-flow restrictor to cause the flow of the hydraulic fluid to follow a rotational path. A frangible member may be disposed within the fluid-flow path to occlude the path until pressure of the hydraulic fluid exceeds a threshold value.

20 Claims, 7 Drawing Sheets

(56) References Cited

U.S. PATENT DOCUMENTS

| | | | | |
|---|---|---|---|---|
| 4,687,063 | A | 8/1987 | Gilbert | |
| 5,070,972 | A * | 12/1991 | Dourson | F16F 9/3214 137/808 |
| 5,103,906 | A * | 4/1992 | Schultz | E21B 34/108 166/169 |
| 6,145,595 | A * | 11/2000 | Burris, II | E21B 34/108 137/68.23 |
| 6,328,055 | B1 * | 12/2001 | Burris, II | E21B 34/108 137/599.11 |
| 7,681,652 | B2 | 3/2010 | Gaudette et al. | |
| 2003/0098164 | A1 | 5/2003 | Hirth | |
| 2008/0230235 | A1 | 9/2008 | Loughlin | |
| 2010/0051284 | A1 | 3/2010 | Stewart | |
| 2010/0252278 | A1 | 10/2010 | Harris et al. | |
| 2011/0297385 | A1 | 12/2011 | Dykstra et al. | |
| 2012/0048561 | A1 * | 3/2012 | Holderman | E21B 34/10 166/316 |
| 2012/0111577 | A1 | 5/2012 | Dykstra et al. | |
| 2012/0181037 | A1 | 7/2012 | Holderman | |

* cited by examiner

100

102
114
118
122
120
124
138
116
104
110
126
112
108
128
130

132
136

134
136
110

FLOW GUIDES FOR REGULATING PRESSURE CHANGE IN HYDRAULICALLY-ACTUATED DOWNHOLE TOOLS

FIELD OF THE INVENTION

The disclosure relates to oil and gas exploration and production, and more particularly, to the regulation of fluid flow in hydraulic tools.

DESCRIPTION OF RELATED ART

Crude oil and natural gas occur naturally in subterranean deposits and their extraction includes drilling a well. The well provides access to a production fluid that often contains crude oil and natural gas. Generally, drilling of the well involves deploying a drill string into a formation. The drill string includes a drill bit that removes material from the formation as the drill string is lowered to form a wellbore. After drilling and prior to production, a casing may be deployed in the wellbore to isolate portions of the wellbore wall and prevent the ingress of fluids from parts of the formation that are not likely to produce desirable fluids. After completion, a production string may be deployed into the well to facilitate the flow of desirable fluids from producing areas of the formation to the surface for collection and processing.

A variety of packers and other tools may operate in the wellbore to fix the production string relative to a casing or wellbore wall, and may also function isolate production zones of the well so that hydrocarbon-rich fluids are collected from the wellbore in favor of undesirable fluids (such as water). These packers and tools may be set in place using a hydraulic setting tool that actuates upon receiving a fluid at a hydrostatic pressure that exceeds the threshold necessary to actuate the tool.

DETAILED DESCRIPTION OF ILLUSTRATIVE EMBODIMENTS

Figures 1, 2A, 2B:
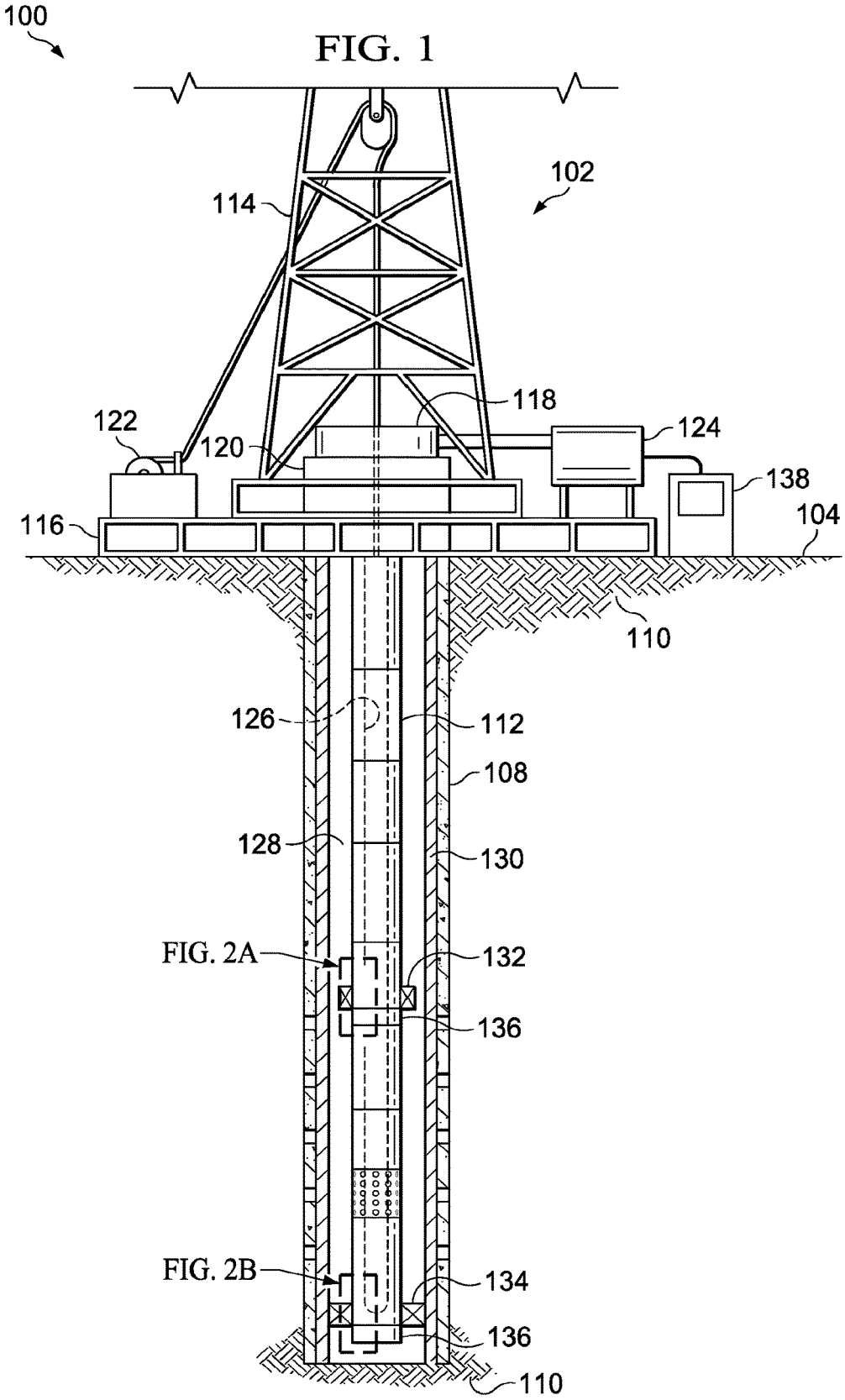
FIG. 1 is a schematic, elevation view with a portion shown in cross-section of an illustrative embodiment of a hydraulic system that includes a downhole tool that is actuated using hydrostatic pressure.
FIG. 2A is a detail view of a portion of the system of FIG. 1 that shows a portion of a hydraulic setting tool and a packer prior to actuation of the hydraulic setting tool and setting of the packer.
FIG. 2B is a detail view of a portion of the system of FIG. 1 that shows a portion of a hydraulic setting tool and a packer following actuation of the hydraulic setting tool and setting of the packer.
Figure 2A:
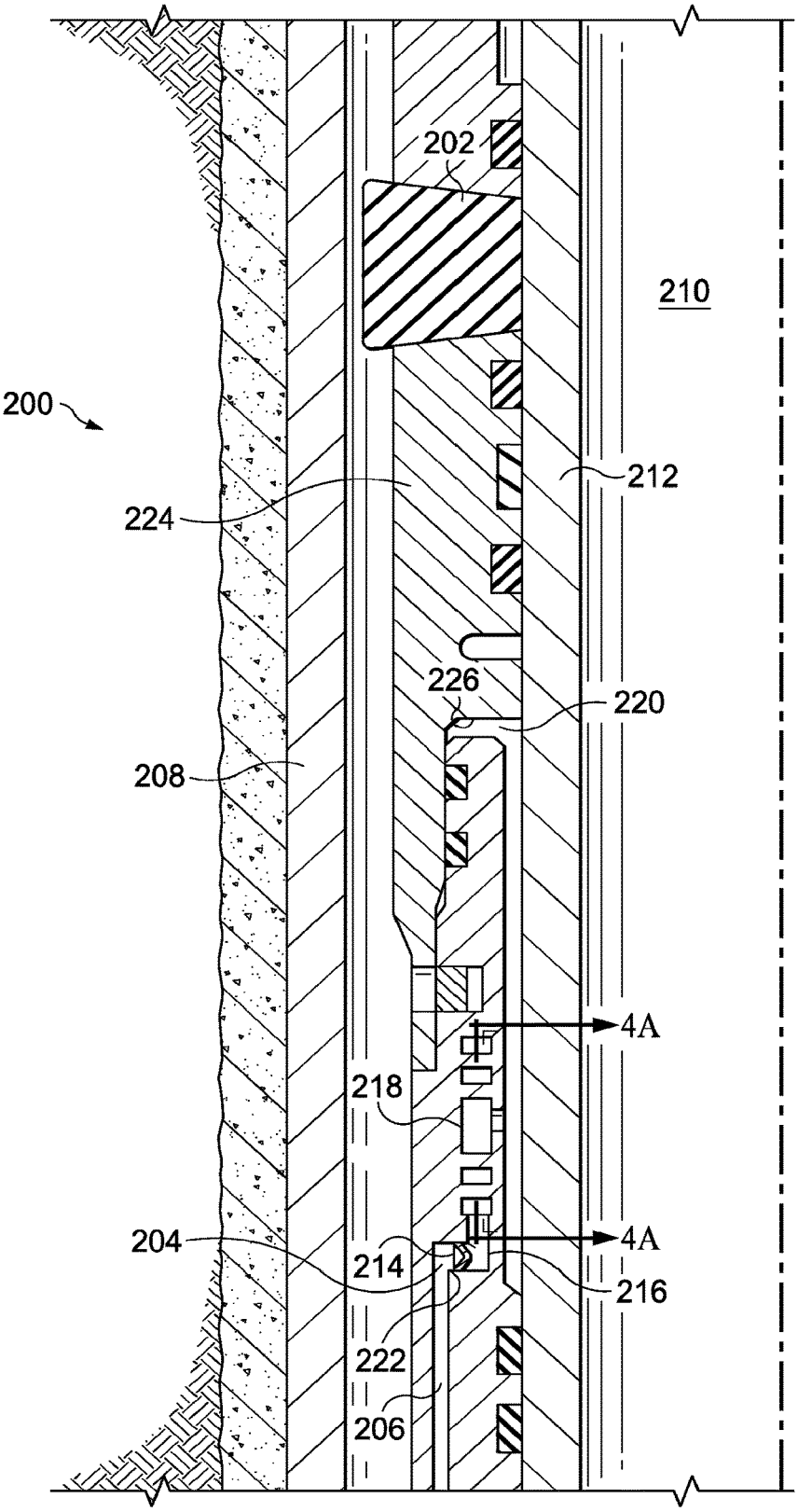
Figure 2B:
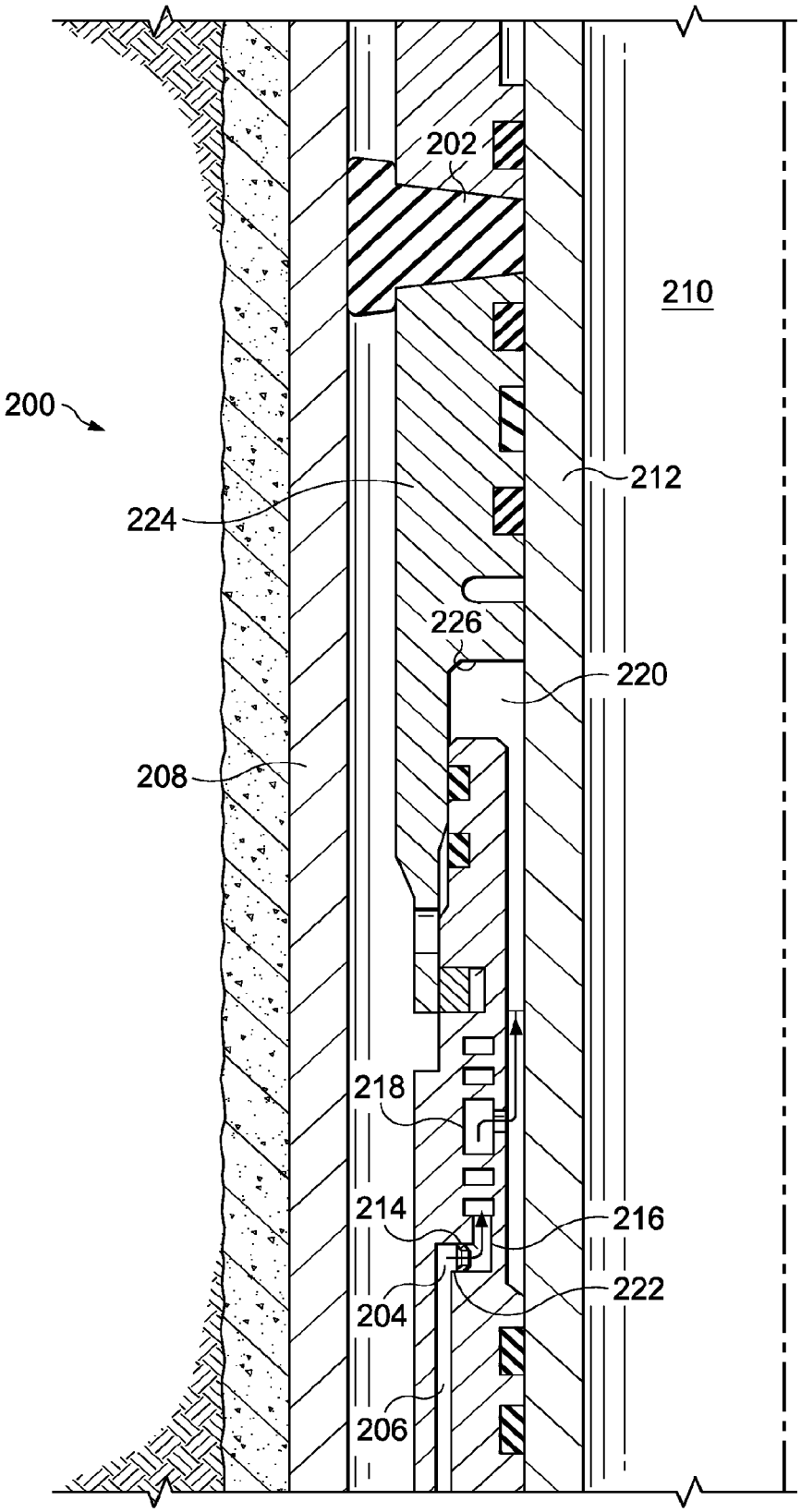

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

In the drawings and description that follow, like parts are typically marked throughout the specification and drawings with the same reference numerals or coordinated numerals. The drawing figures are not necessarily to scale. Certain features of the invention may be shown exaggerated in scale or in somewhat schematic form and some details of conventional elements may not be shown in the interest of clarity and conciseness.

As noted above, packers and other downhole equipment tools may be set in place using a hydraulic setting tool that actuates upon receiving a fluid at a hydrostatic pressure that exceeds the threshold necessary to actuate the tool. The embodiments described herein relate to systems, tools, and methods for actuating a hydraulic downhole tool that include the use of a controller, a hydraulic conduit, and a hydraulic setting tool coupled to the controller and the hydraulic conduit. The hydraulic downhole tool may be any downhole tool that is actuated by opening a hydrostatic chamber to an atmospheric chamber. In many of the illustrative embodiments described herein, the hydraulic downhole tool is a hydraulic setting tool. The illustrative hydraulic setting tool has a first chamber fluidly coupled to the hydraulic conduit and a second chamber separated from the first chamber by a frangible member. A fluid-flow path couples the first chamber to the second chamber.

In operation, the hydraulic setting tool is actuated by the hydrostatic pressure of fluid in the first chamber increasing beyond a predetermined threshold, resulting in fracture of the frangible member. In other embodiments, the frangible member may be an actively triggered frangible element, such as a valve or electronic rupture disc that is manually actuated or actuated automatically in response to a trigger condition, such as the presence of a control signal, the presence of a chemical composition, or a pressure in the first chamber reaching a predetermined threshold. The actuation of the frangible member allows relatively high-pressure fluid to flow from the first chamber to the second chamber, which may include vacuum or a relatively low-pressure, compressible fluid, such as air, at atmospheric pressure or another pressure that is less than the pressure of the fluid in the first chamber prior to actuation of the frangible member. The inflow of pressurized fluid results in an actuation force being applied to elements of the set tool from the second chamber. To prevent the inflow of fluid from occurring too rapidly, which may result in damage to the set tool or other equipment that is set by the set tool, in an embodiment, a fluid-flow restrictor is placed in the fluid-flow path to induce a vortex or vortex-like flow pattern in the fluid. The vortex or vortex-like flow pattern reduces the rate of acceleration of fluid flow from the first chamber to the second chamber, thereby reducing impact caused by rapid actuation of the set tool, which may improve longevity and avoid damage to tools and equipment set by the tool.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The various characteristics mentioned above, as well as other features and characteristics described in more detail below, will be readily apparent to those skilled in the art with the aid of this disclosure upon reading the following detailed description of the embodiments, and by referring to the accompanying drawings. Other means may be used as well.

Referring now to FIG. 1, an illustrative embodiment of a hydraulic system 100 that includes a downhole tool that is actuated using hydrostatic pressure is presented. The hydraulic system 100 includes a rig 102 atop a surface 104 of a well 106. Beneath the rig 102, a wellbore 108 is formed within a geological formation 110, which is expected to produce hydrocarbons. The wellbore 108 may be formed in the geological formation 110 using a drill string that includes a drill bit to remove material from the geological formation 110. The wellbore 108 of FIG. 1 is shown as being near-vertical, but may be formed at any suitable angle to reach a hydrocarbon-rich portion of the geological formation 110. In some embodiments, the wellbore 108 may follow a vertical, partially-vertical, angled, or even a partially-horizontal path through the geological formation 110.

A production tool string 112 is deployed from the rig 102, which may be a drilling rig, a completion rig, a workover rig, or another type of rig. The rig 102 includes a derrick 114 and a rig floor 116. The production tool string 112 extends downward through the rig floor 116, through a fluid diverter 118 and blowout preventer 120 that provide a fluidly sealed interface between the wellbore 108 and external environment, and into the wellbore 108 and geological formation 110. The rig 102 may also include a motorized winch 122 and other equipment for extending the production tool string 112 into the wellbore 108, retrieving the production tool string 112 from the wellbore 108, and positioning the production tool string 112 at a selected depth within the wellbore 108. Coupled to the fluid diverter 118 is a pump 124. The pump 124 is operational to deliver or receive fluid through a fluid bore 126 of the production tool string 112 by applying a positive or negative pressure to the fluid bore 126. As referenced herein, the fluid bore 126 is the flow path of fluid from an inlet of the production tool string 112 to the surface 104. The pump 124 may also deliver or receive fluid through an annulus 128 formed between the wall of the wellbore 108 and exterior of the production tool string 112 by applying a positive or negative pressure to the annulus 128. The annulus 128 is formed between the production tool string 112 and a wellbore casing 130 when production tool string 112 is disposed within the wellbore 108.

Following formation of the wellbore 108, the production tool string 112 may be equipped with tools and deployed within the wellbore 108 to prepare, operate, or maintain the well 106. Specifically, the production tool string 112 may incorporate tools that are hydraulically-actuated after deployment in the wellbore 108, including without limitation bridge plugs, composite plugs, cement retainers, high expansion gauge hangers, straddles, or packers. Actuation of such tools may result in centering the production tool string 112 within the wellbore 108, anchoring the production tool string 112, isolating a segment of the wellbore 108, or other functions related to positioning an operating the production tool string 112. In the illustrative embodiment shown in FIG. 1, the production tool string 112 is depicted with packers 132, 134 for isolating segments of the wellbore 108. Packers 132, 134 are typically used to prepare the wellbore 108 for hydrocarbon production (e.g., fracturing) or for service during formation (e.g., acidizing or cement squeezing). In FIG. 1, one packer 132 is presented as un-actuated and the other packer 134 as actuated to form a seal against the wall of the wellbore 108.

To actuate tools for use in the wellbore 108, such as the packer 132, the production tool string 112 includes a hydraulic setting tool 136. In an illustrative embodiment, the hydraulic setting tool 136 is coupled to the packer 132 and further coupled to a hydraulic conduit of the hydraulic system 100. As referenced herein, the hydraulic conduit may be understood to include the annulus 128, the fluid bore 126, or one or more channels internal to a wall of the production tool string 112 to provide fluid to the hydraulic setting tool 136. To control the actuation of the hydraulic setting tool 136, the system 100 may also include a controller 138 which may be coupled to, for example, the pump 124 to provide a pressure pulse, increased pressure, or another hydraulic control signal to the hydraulic setting tool 136.

It is noted that while the operating environment shown in FIG. 1 relates to a stationary, land-based rig for raising, lowering, and setting the production tool string 112, in alternative embodiments, mobile rigs, wellbore servicing units (e.g., coiled tubing units, slickline units, or wireline units), and the like may be used to lower the production tool string 112. Furthermore, while the operating environment is generally discussed as relating to a land-based well, the systems and methods described herein may instead be operated in subsea well configurations accessed by a fixed or floating platform.

Referring now to FIG. 2A, a portion of an illustrative embodiment of a hydraulic setting tool 200 is shown in cross-section. Specifically, FIG. 2A depicts the hydraulic setting tool 200 coupled to a packer 202 prior to the setting of the packer 202. The hydraulic setting tool 200 includes a first chamber 204 that is fluidly-coupled to a hydraulic conduit to receive fluid at a hydrostatic pressure. In an embodiment, the first chamber may simply be a portion of the hydraulic conduit. The hydraulic conduit may be the fluid bore 210 of a production tool string or a hydraulic control line 206, as shown in FIG. 2A. The first chamber 204 is configured to receive a hydraulic fluid from the hydraulic conduit and establish a hydrostatic pressure therein. The hydrostatic pressure may be increased to actuate the hydraulic setting tool 200. The hydraulic fluid may be a production fluid, a drilling fluid, or another hydraulic fluid that is naturally or artificially supplied to the fluid bore 210 from the formation or surface. The hydraulic setting tool 200 includes a frangible member 214 that is coupled to a fluid outlet 222 from the first chamber 204. The frangible member 214 may be a rupture disc, a disc supported by one or more shear pins, a valve held closed by one or more shear pins, or any other suitable frangible member that is operable to automatically actuated and allow fluid flow through the outlet 222 of the first chamber 204 when the hydrostatic pressure in the first chamber 204 reaches a predetermined pressure. Prior to actuation, the frangible member 214 prevents fluid flow between the first chamber 204 and a second chamber 220.

Absent the frangible member 204, or following rupture of the frangible member 204, the outlet 222 of the first chamber 204 is fluidly coupled to a fluid flow path 216 that flows from the outlet 222 of the first chamber 204, through a fluid-flow restrictor 218, and into the second chamber 220. In an embodiment, the fluid-flow restrictor 218 is formed to cause the fluid to follow a rotational flow path as the fluid flows from the first chamber 204 to the second chamber 220 as described in more detail below.

FIG. 2B shows an embodiment of the hydraulic setting tool 200 and packer 202 following actuation of the hydraulic setting tool 200. When the pressure in the first chamber 204 increases beyond a predetermined threshold, the frangible member 214 ruptures, allowing hydraulic fluid to flow through the outlet 222 of the first chamber 204 along the fluid flow path 216 into the second chamber 220. The second chamber 220 is enclosed on one side by a drive surface 226 of an actuator 224, which may function as a piston to set the packer 202 by directly or indirectly exerting a force against the packer 202. The exerted force may be applied by the actuator 224 to cause the actuator 224 to exert a force against, for example, an elastomeric packer member that expands to engage a surface of a casing 208 or by causing a cammed surface of the actuator 224 to engage a complementary cammed surface of a packer to cause the packer to slide outward to engage the casing 208.

To engage the actuator 224, hydraulic fluid flows from the first chamber 204, through the fluid-flow restrictor 218, and into the second chamber 220. In an embodiment, the fluid-flow restrictor 218 functions to reduce the flow rate of the fluid from the first chamber 204 to the second chamber, thereby minimizing impact and other instantaneous loads generated following actuation of the frangible member 214. The fluid-flow restrictor 218 is shown in FIG. 2A as being located between the frangible member 214 and the second chamber 220, though in other embodiments, the frangible member 214 may be disposed between the fluid-flow restrictor 218 and the second chamber 220. The illustrative embodiments of the fluid-flow restrictor are described in more detail below with regard to FIGS. 3A and 3B. In an embodiment, a tool that includes the fluid-flow restrictor 218 may include one or more fluid-flow restrictors, which may be arranged in series or in parallel. In addition, as described in more detail below, the extent to which a fluid-flow restrictor 218 functions to reduce pressure drop may be a function of the orientation of the fluid-flow restrictor. With regard to the figures discussed below, for example, fluid is generally considered to flow into the inlet of the fluid-flow restrictor and out of an outlet of the fluid-flow restrictor. In such embodiments, if flow were reversed, the fluid-flow restrictor may provide less of an impedance to flow and many not have the desired effect on the flow of fluid through the fluid-flow restrictor. To regulate flow in devices that are actuated multiple times or in multiple directions, two or more fluid-flow restrictors may be arranged in series at opposing orientations so that a first fluid-flow restrictor regulates flow as fluid flows in a first direction and a second fluid-flow restrictor regulates flow as fluid flows in a second direction, the second flow direction being opposite the first direction. Such an arrangement may provide for a tool having back-to-back fluid-flow restrictors that provide the same flow restriction regardless of the direction of the flow. In addition, such an arrangement would result in a fluid-flow restrictor that has symmetrical flow restriction properties, so that flow effects would be the same in either direction and a manufacturer could easily install the fluid-flow restrictor in an assembly without regard to its orientation or concern about installing the fluid flow restrictor backwards.

Figure 3A:
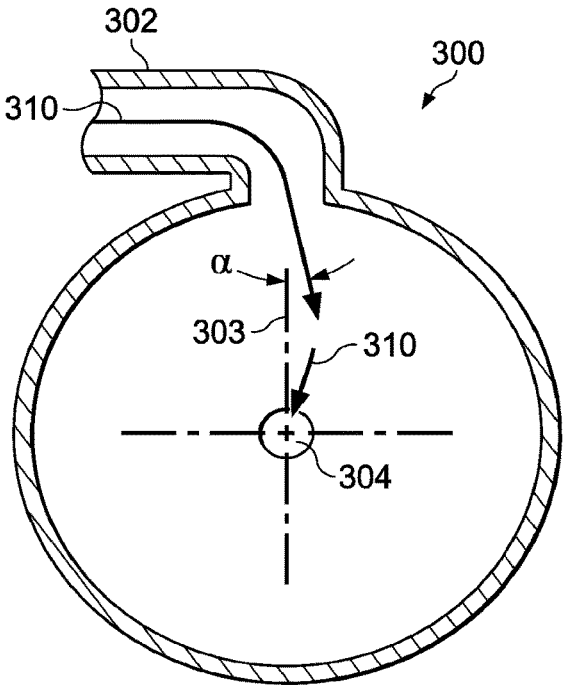
FIG. 3A is a section view of a fluid-flow restrictor that may be disposed in a fluid flow path through the hydraulic set tool of FIGS. 2A and 2B, similar to the fluid-flow restrictor described with regard to FIG. 4A, in which a high-velocity fluid is flowing through the fluid-flow restrictor.
Figure 3B:
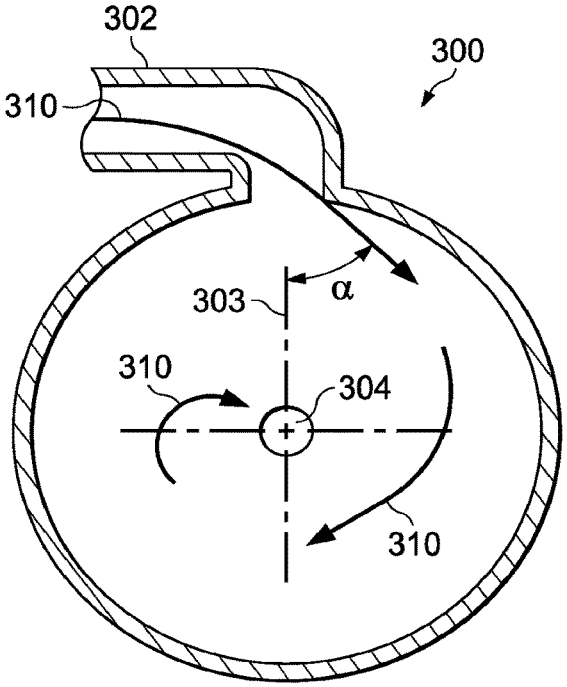
FIG. 3B is a cross-section view of the fluid-flow restrictor of FIG. 3A, in which a low-velocity fluid is flowing through the fluid-flow restrictor.

FIGS. 3A and 3B show a fluid-flow restrictor 300, which is analogous to the fluid-flow restrictor described above with regard to FIGS. 2A and 2B, for transmitting fluid within a hydraulic tool. For reference, the cross-section of FIG. 3A is derived from the section view of the fluid-flow path shown in FIGS. 2A and 2B. FIG. 3B provides an additional section view of the fluid-flow restrictor 300, as indicated by the arrows 3B-3B.

The fluid-flow restrictor 300 includes a fluid inlet 302 to receive fluid from a hydraulic conduit or first chamber of a hydraulic tool, as described above. While the fluid-flow restrictor 300 is described herein as a component of a hydraulic setting tool, the fluid-flow restrictor may also be included in any hydraulically actuated tools that are actuated by opening a hydrostatic chamber to an atmospheric chamber. For example, the fluid-flow restrictor 300 may also be included in bridge plugs, composite plugs, cement retainers, high expansion gauge hangers, straddles, packers, sleeves, valves, actuators, and other tools. In addition to the fluid inlet 302, the fluid-flow restrictor 300 also includes a fluid outlet 304 to deliver fluid to apply a force to an actuation member of a hydraulic tool by, for example, transmitting fluid to a second chamber of the hydraulic tool, which may also be referred to herein as an actuation chamber.

In the embodiment of FIGS. 3A and 3B, fluid enters the fluid-flow restrictor 300 from the inlet 302 flows through the fluid-flow restrictor 300 to the outlet 304. The resistance to fluid flow through the fluid-flow restrictor 300 may vary based on the properties of the fluid. For example, in the embodiment shown in FIG. 3A, a relatively high velocity, low viscosity fluid from the inlet 302 into a cavity of the fluid-flow restrictor 300. The inlet 302 may have a curve or other change in direction to direct flow into the cavity of the fluid-flow restrictor 300. The cavity may be regarded as generally cylindrical in shape and as such, the fluid is directed along a flow path that is generally tangential to the boundary of the cavity. The relatively high velocity and low viscosity of the fluid results in the fluid flow path not being substantially affected by the change in direction of the inlet, and the fluid following a flow path through the cavity at an angle $\alpha$ (relative to the vertical reference line 303), resulting in a rotational or vortex-like flow path that the fluid follows as it spirals toward the outlet 304. The embodiment of FIG. 3A thereby provides a flow path of increased length that results in increased fluid velocity and an associated increase in resistance to flow, which may moderate the rate of change of pressure across the fluid-flow restrictor 300.

FIG. 3B shows that a relatively low velocity, high viscosity fluid will not follow the same flow path, because such a fluid will be more effectively redirected by the shape of the inlet 302 and thereby will not experience the same degree of resistance to flow as the high velocity fluid. It follows that the geometry illustrated in FIGS. 3A and 3B is somewhat self-moderating in terms of the degree to which the rate of pressure change is slowed, which provides for a relatively tunable fluid-flow restrictor 300 that may be sized and shaped to permit optimized rates of pressure change and flow that are selected based on the operating parameters of the tool and the rates of pressure change at which a tool that incorporates the fluid-flow restrictor 300 will actuate without experiencing excessive impact or deformation.

Figure 4A:
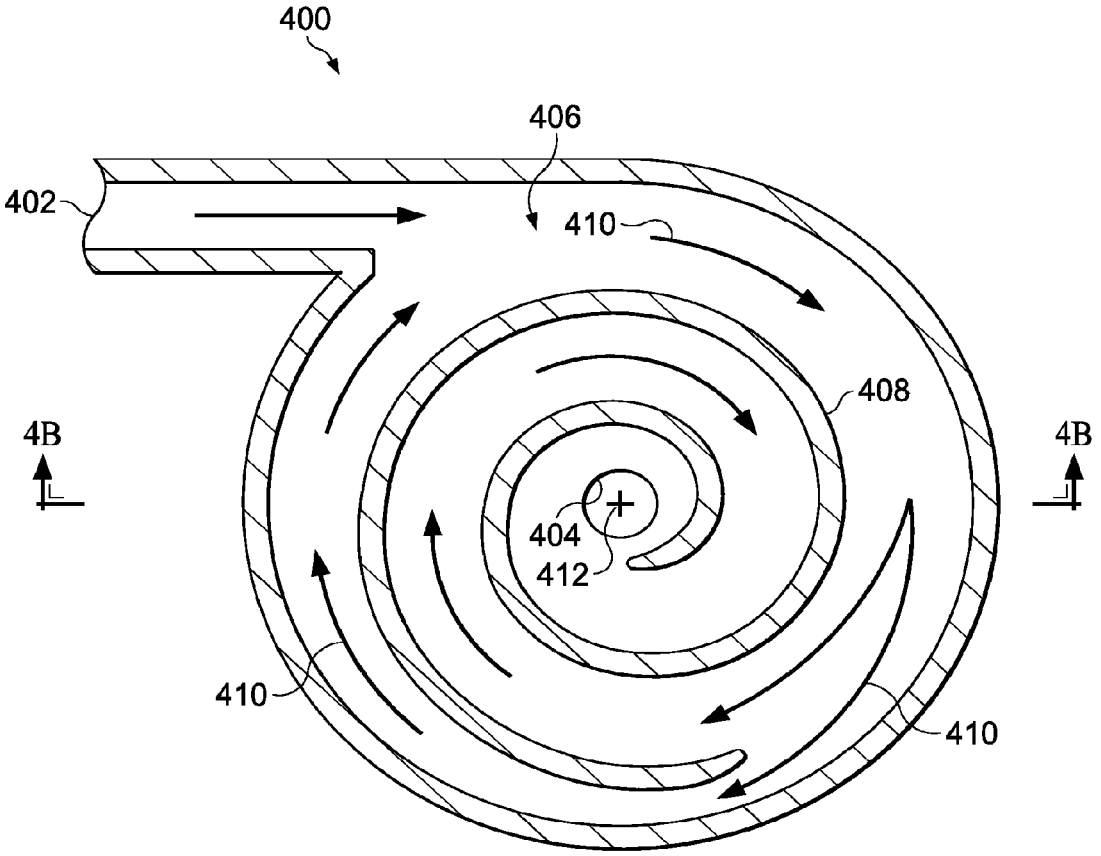
FIG. 4A is a section view of an alternative embodiment of a fluid-flow restrictor that is analogous to the fluid-flow restrictor of FIG. 3A.
Figure 4B:
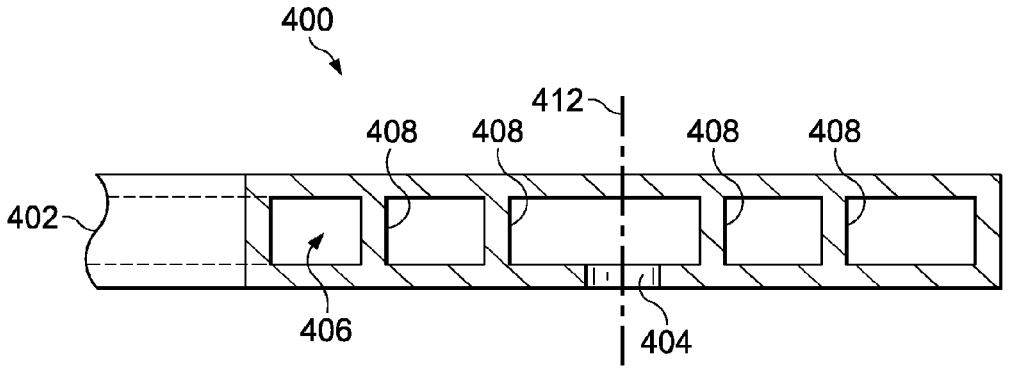
FIG. 4B is a cross-section view of the fluid-flow restrictor of FIG. 4A, as indicated by the arrows 4B-4B in FIG. 4A.

In another embodiment, as shown in FIGS. 4A and 4B, a fluid-flow path 406 extends from the fluid inlet 402 to the fluid outlet 404. The fluid-flow path 406 is operable to connect a hydraulic control line, or hydraulic conduit to the actuation chamber of the hydraulic tool and to allow transmission of fluid therebetween. The fluid-flow path 406 includes at least one guide member 408 disposed between the fluid inlet 402 and the fluid outlet 404. The guide member 408, whether singular or as a plurality, may be an arcuate, or curved vane that is positioned to direct fluid from the fluid inlet 402 into a rotational flow path 410 relative to a longitudinal axis 412 of the fluid outlet 404.

In an embodiment, the fluid inlet 402 is configured to introduce fluid received from the hydraulic conduit along a direction that is tangential relative to the generally cylindrical body of the fluid-flow restrictor 400. In other embodiments, the guide member 408 includes a plurality of vanes forming a vortex-inducing flow path 410. In such embodiments, the fluid outlet 404 may be positioned to collect fluid from a center of the vortex-inducing flow path 410.

In operation, the fluid-flow restrictors described above reduce the rate at which hydraulic fluid flows from a hydraulic conduit to an actuation chamber to reduce the impact on a hydraulic tool during an actuation event. In an embodiment, a fluid inlet of the fluid-flow restrictor receives fluid at a high pressure from the hydraulic conduit and directs the fluid along a fluid-flow path through the fluid-flow restrictor. A pressure differential between the hydraulic conduit and the actuation chamber of the hydraulic tool induces flow from the hydraulic conduit to the actuation chamber. A valve or frangible member, if present, occludes transmission through the fluid-flow path until the pressure in the hydraulic conduit reaches a predetermined threshold. The valve may be configured to open or the frangible member may be engineered to break when the predetermined threshold is exceeded to allow fluid to flow from the hydraulic conduit to the actuation chamber. The shape of the cavity of the fluid-flow restrictor and an optional one or more guide members 408 direct fluid from the fluid inlet along a rotational flow path and towards the fluid outlet to the actuation chamber. To reduce impact upon actuation of the hydraulic tool, the rotational flow path regulates a rate of pressure increase in the actuation chamber during transmission of fluid.

Figure 5A:
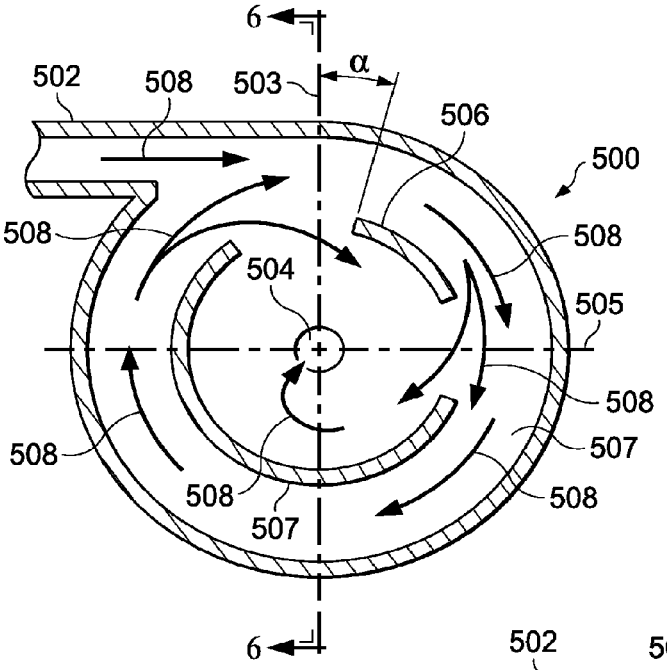
FIG. 5A is a schematic, cross-section view of an alternative embodiment of a fluid-flow restrictor according to an illustrative embodiment.
Figure 5B:
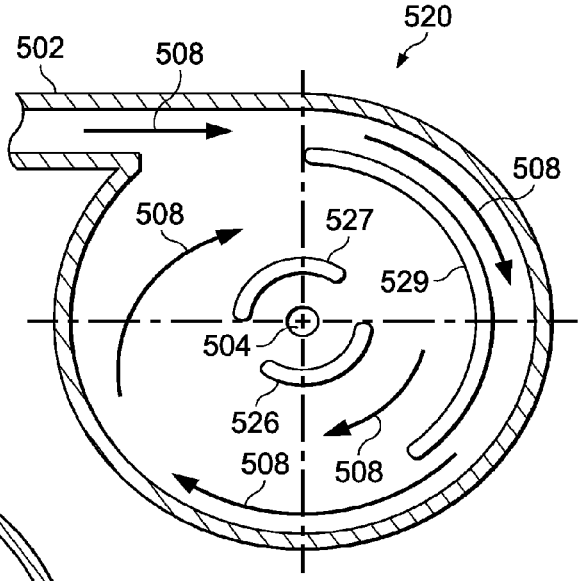
FIG. 5B is a schematic cross-section view of a second alternative embodiment of a fluid-flow restrictor.
Figure 5C:
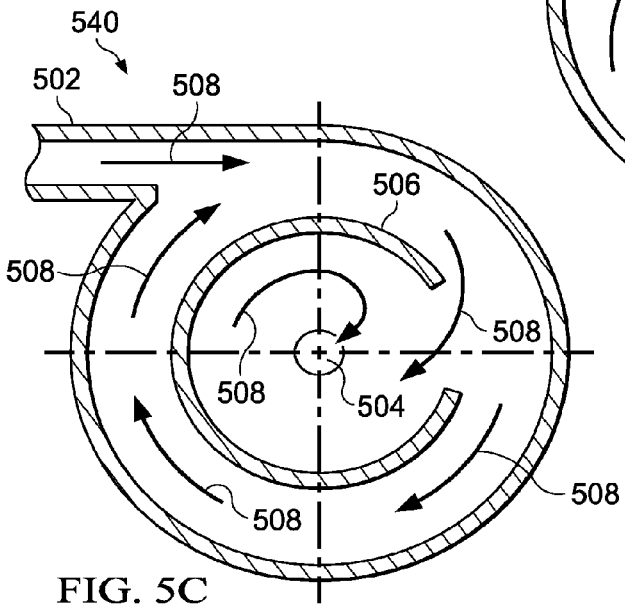
FIG. 5C is a schematic cross-section view of a third alternative embodiment of a fluid-flow restrictor.

Referring now to FIGS. 5A-5C, alternative embodiments of fluid-flow restrictors 500, 520, 540 are presented. The fluid-flow restrictors 500, 520, 540 are analogous to the fluid-flow restrictor 400 described above in regards to FIGS. 4A and 4B but differ in certain respects relating to the structures included in each embodiment for inducing a rotational fluid-flow pattern in a hydraulic fluid flowing through the fluid-flow restrictor.

Referring more particularly to FIG. 5A, an illustrative embodiment of a fluid-flow restrictor for use in a hydraulic tool includes a fluid inlet 502 for receiving a hydraulic fluid from a hydrostatic chamber or conduit. The fluid inlet 502 is configured to introduce the hydraulic fluid in a direction tangential to the outer surface of the generally elliptical or cylindrical body of the fluid-flow restrictor 500. Guide members 506 are disposed within the fluid-flow restrictor 500 to induce rotational flow in the hydraulic fluid being transmitted through the fluid-flow restrictor 500. In the embodiment of FIG. 5A, the guide members 506 include two arcuate members 506, 507, which may also be referred to as arcuate vanes, that are generally concentric with the body of the fluid-flow restrictor 500 relative to the outlet 504. A vertical reference line 503 and horizontal reference line 505 are shown for reference, and the inlet 502 is generally shown as introducing fluid to the fluid-flow restrictor along a tangential flow path that is approximately parallel to the horizontal reference line 505. The arcuate members may extend through all of the fluid-flow restrictor, like the guide member 408 of FIG. 4B, or may extend through only a portion of the fluid-flow restrictor by, for example, extending from a surface of the fluid-flow restrictor to approximately one-quarter, on-half, or three-quarters of the distance to the opposing surface of the fluid-flow restrictor.

As shown in FIG. 5A, a first arcuate member 506 may begin at the vertical reference line 503 or at an angle $\alpha$, which may be, for example, 10° from the vertical reference line 503, and extend to a second angle that is, for example, 20° from the vertical reference line 503. The first arcuate member 506 may have an outer surface that is approximately the same distance from the outlet 504 as the inner surface of the inlet 502. In another embodiment, the first arcuate member 506 may have an outer surface that closer to the outlet 504 than the inner surface of the inlet 502. The first arcuate member 506 may be of nominal thickness and function to maintain a rotational flow pattern in fluid flowing through the fluid-flow restrictor 500. In an illustrative embodiment, a second arcuate member 507 begins at another angle from the vertical reference line 503 that allows for a gap between the first arcuate member 506 and second arcuate member 507 to flow toward the outlet 504. A second gap is formed between the opposing ends of the first arcuate member 506 and second arcuate member 507 to allow additional fluid to flow toward the outlet 504. The second arcuate member 507 may start at an angle that is approximately 40° (taken in a clockwise direction) from the vertical reference line 503 and end at an angle that is approximately 345° from the vertical reference line 503. In an embodiment, the second arcuate member 507 may be set approximately the same distance from the outlet 504 as the first arcuate member 506.

Possible fluid-flow paths around the arcuate members 506, 507 and through the gaps are marked by arrows 508 in FIG. 5A. Any number, arrangement, configuration, or combination thereof of arcuate members 506, 507 may be used in keeping with the principles of this disclosure. For example, FIGS. 5B and 5C depict additional embodiments of fluid-flow restrictors 520, 540 having different arrangements of arcuate members. In each of the illustrative embodiments, hydraulic fluid enters the fluid-flow restrictor 500 through the fluid inlet 502 and encounters the arcuate guide members, and the arcuate guide members 506 induce rotational flow in the hydraulic fluid around the fluid outlet 504. The hydraulic fluid spirals around and inwards until reaching the fluid outlet 504 where it exits the fluid-flow restrictor 500, as indicated by the arrows. The embodiment of FIG. 5B, for example, includes a plurality of concentric arcuate members that includes an outer arcuate member 529 and a pair of inner arcuate members 526, 527. Similarly, the embodiment of FIG. 5C includes only a single arcuate member 546.

In addition to or in place of the arcuate members described above, in an illustrative embodiment, the fluid-flow restrictor may include a shaped surface to include a vortex or rotational flow an inlet to an outlet of a fluid-flow restrictor. In other embodiments, the arcuate members may be formed from the shaped surfaces shown in FIGS. 6A-6C. Several illustrative embodiments of such shaped surfaces and similar mechanisms for altering flow are depicted in FIGS. 6A-6E. The cross-sectional views of FIGS. 6A-6D are taken along line 6-6 of FIG. 5A and FIG. 6E is taken along line 6E-6E of FIG. 6D.

Figure 6A:
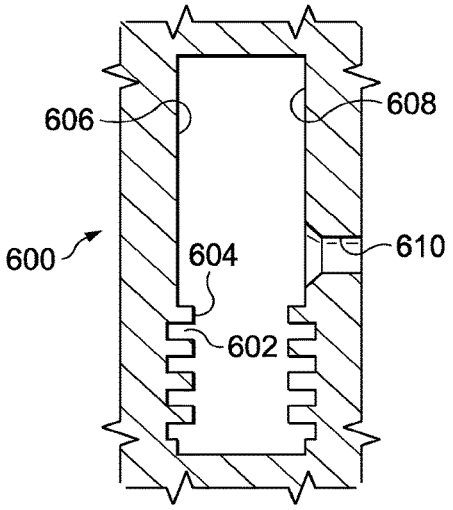
FIGS. 6A-6E are schematic, cross-section views of fluid-flow restrictors having a variety of shaped guide surfaces according to various illustrative embodiments, with FIGS. 6A-6D being taken along section line 6-6 of FIG. 5A and FIG. 6E being taken along section line 6E-6E of FIG. 6D.

In FIG. 6A, the shaped surface includes multiple circumferential recesses 602 and projections 604, which may be viewed as square groves formed on an upper wall 606 and a lower wall 608 of the fluid-flow restrictor 600. The recesses 602 and projections 604 resist radial flow of hydraulic fluid inward towards a fluid outlet 610 and induce laminar flow in a rotational flow path about the outlet 610.

Figure 6B:
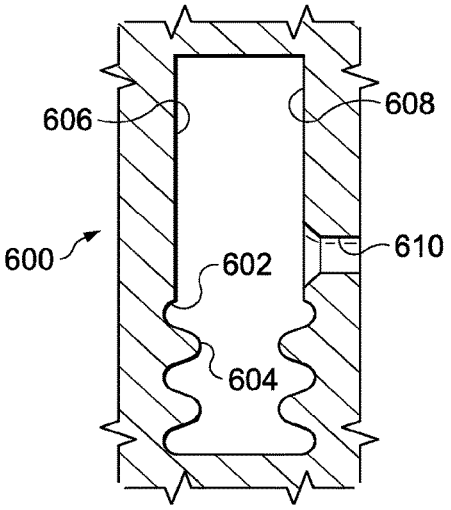

In FIG. 6B, the shaped surface includes multiple circumferentially extending undulations formed on the walls 606, 608 of the fluid-flow restrictor. Similar to the configuration of FIG. 6A, the undulations include recesses 602 and projections 604 and may be viewed as oscillatory grooves formed in the walls 606, 608 of the fluid-flow restrictor 600.

Figure 6C:
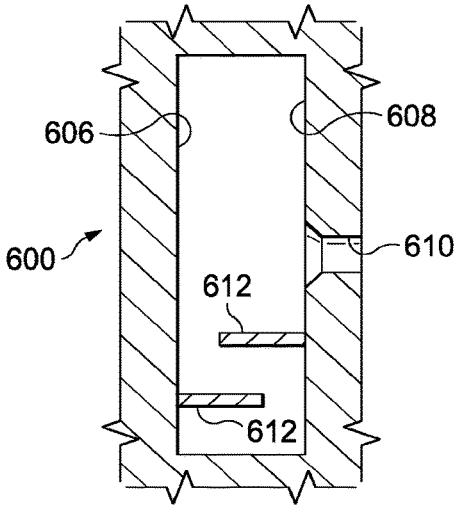

In FIG. 6C, the guide members 600 include circumferentially extending, but radially offset walls or vanes 612 protruding inwardly from the walls 604, 606 of the fluid-flow restrictor. Any number, arrangement, configuration, or combination thereof of walls or vanes 612 may be used, in keeping with the principals of this disclosure, in order to resist radial flow of hydraulic fluid inward towards a fluid outlet 610 and encourage rotational or vortex-like flow toward the outlet.

Figure 6D:
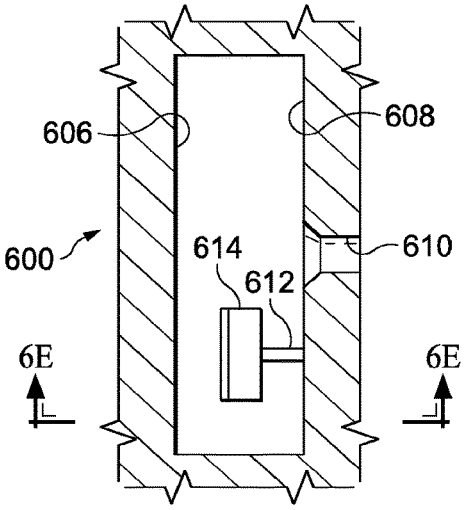
Figure 6E:
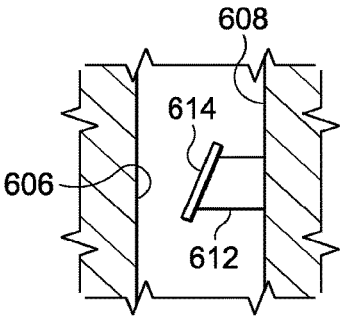

In FIG. 6D, the guide members 600 include a wall or vane 612 extending inwardly from the wall, with a deflector 614 which influences hydraulic fluid to change direction relative to the fluid outlet 610. The deflector 614 may be configured to direct hydraulic fluid to flow axially away from, or toward, the fluid outlet 610. In such embodiments, the deflector 614 increases resistance to flow of fluid circularly in the fluid-flow restrictor, provides resistance to flow of fluid at different axial levels of the chamber, or both. Any number, arrangement, configuration, or combination thereof of deflectors 614 may be used, in keeping with the principals of this disclosure.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment.

For example, an illustrative system according to the present disclosure includes a controller, a hydraulic conduit, and a hydraulic tool coupled to the controller and the hydraulic conduit. The hydraulic tool includes a first chamber fluidly coupled to the hydraulic conduit, a second chamber separated from the first chamber by a frangible member, and a rotational fluid-flow path from the first chamber to the second, the fluid-flow path containing a fluid-flow restrictor. In an embodiment, the system further includes a frangible member that prevents fluid flow from the first chamber to the second chamber when the frangible member is in an unactuated state and permits fluid flow from the first chamber to the second chamber when the frangible member is in an actuated state. The frangible member is operable to fracture or otherwise automatically actuated when a pressure differential between the first chamber and the second chamber exceeds a predetermined threshold.

In an embodiment, the first chamber is fluidly coupled to a hydraulic conduit, and may comprise a hydraulic control line, a portion of the hydraulic conduit, or an annulus of a wellbore. The frangible member is disposed between the first chamber and the second chamber or the first chamber may be disposed between the frangible member and the second chamber. The frangible member may include a rupture disc or a shear pin.

In an embodiment, the fluid-flow restrictor comprises a vortex-inducing fluid-flow restrictor. The vortex-inducing fluid-flow restrictor may include at least one arcuate vane, a plurality of concentric arcuate vanes, or a plurality of arcuate vanes that are equidistant from an outlet of the fluid-flow restrictor. In addition, the fluid-flow restrictor may include a shaped surface According to another illustrative embodiment, an apparatus for transmitting fluid within a hydraulic tool includes a first chamber that is at a first pressure at a first time, and a second chamber that is at a second pressure at the first time and at a third pressure at a second time, where the first pressure is greater than the second pressure and approximately equal to the third pressure. The apparatus further includes a fluid-flow path from the first chamber to the second chamber, the fluid-flow path comprising a fluid inlet to receive fluid into the fluid-flow path from the first chamber, a fluid outlet to deliver fluid to the second chamber from the fluid flow path, and at least one fluid-flow restrictor disposed between the fluid inlet and the fluid outlet to direct fluid received from the fluid inlet into a rotational flow path around a longitudinal axis of the fluid outlet.

The fluid inlet of the apparatus is configured to introduce fluid received from the hydrostatic chamber along a direction that is tangential to the rotational flow path. In addition, the fluid-flow restrictor includes a plurality of guide vanes forming a vortex-inducing flow path. In another embodiment, the fluid-flow restrictor includes at least one arcuate vane, a plurality of concentric arcuate vanes, or a plurality of arcuate vanes that are equidistant from an outlet of the fluid-flow restrictor.

In an embodiment, the fluid-flow restrictor of the apparatus includes a shaped surface, which may be concentric square grooves or concentric oscillatory grooves. The fluid-flow restrictor may also include a vane and a deflector, and the fluid outlet may be configured to collect fluid from a center of the vortex-inducing flow path.

The apparatus may further include a frangible member that is configured to occlude flow through the fluid-flow path until a pressure of the hydraulic chamber reaches a predetermined threshold. The frangible member may include a rupture disc or one or more shear pins.

According to another illustrative embodiment, a method for actuating a hydraulic tool includes generating a hydrostatic pressure in a first chamber and transmitting a fluid through a fluid-flow path from the first chamber to a second chamber, where the fluid-flow path comprises at least one vortex-inducing fluid-flow restrictor. The method also includes actuating the hydraulic tool by transmitting the hydrostatic pressure to the second chamber to generate a hydrostatic force against at least one movable member of the hydraulic tool.

In an embodiment, the method further includes breaking a frangible member in response to the hydrostatic pressure exceeding a threshold pressure, the frangible member being operable to occlude flow through the fluid-flow path until actuated.

The hydraulic tool may be a packer, a bridge plug, a high-expansion gauge hanger, or a cement retainer. In an embodiment, the method of further includes introducing fluid to a fluid inlet of the fluid-flow restrictor along a direction tangential to the fluid flow path, the fluid flow path being a generally rotational fluid flow path. The fluid-flow restrictor may include a plurality of guide vanes forming a vortex-inducing flow path, at least one arcuate vane, a plurality of concentric arcuate vanes, or a plurality of arcuate vanes that are equidistant from the outlet of the fluid-flow restrictor. The fluid-flow restrictor may also include a shaped surface, which may include concentric square grooves or concentric oscillatory grooves. In addition, the fluid-flow restrictor may include a vane and a deflector, and the fluid outlet may be configured to collect fluid from a center of the vortex-inducing flow path.

It will be understood that the benefits and advantages described above may relate to one embodiment or may relate to several embodiments. It will further be understood that reference to "an" item refers to one or more of those items.

The steps of the methods described herein may be carried out in any suitable order or simultaneous where appropriate. Where appropriate, aspects of any of the examples described above may be combined with aspects of any of the other examples described to form further examples having comparable or different properties and addressing the same or different problems.

The illustrative systems, methods, and devices described herein may also be described by the following examples:

Example 1

A system to actuate a hydraulic tool, the system comprising:

a controller;

a hydraulic conduit;

a hydraulic tool coupled to the controller and the hydraulic conduit, the hydraulic tool comprising:

a first chamber fluidly coupled to the hydraulic conduit, a second chamber separated from the first chamber by a frangible member, and a rotational fluid-flow path from the first chamber to the second, the fluid-flow path containing a fluid-flow restrictor.

Example 2

The system of example 1, further comprising a frangible member that prevents fluid flow from the first chamber to the second chamber when the frangible member is in an unactuated state and permits fluid flow from the first chamber to the second chamber when the frangible member is in an actuated state, wherein the frangible member is automatically actuated when a pressure differential between the first chamber and the second chamber exceeds a predetermined threshold.

Example 3

The system of example 1 or 2, wherein the first chamber is fluidly coupled to a hydraulic conduit.

Example 4

The system of example 1 or 2, wherein the first chamber comprises a hydraulic control line.

Example 5

The system of example 1 or 2, wherein the first chamber comprises an annulus of a wellbore.

Example 6

The system of example 2 or any of examples 3-5, wherein the frangible member is disposed between the first chamber and the second chamber.

Example 7

The system of example 2 or any of examples 3-6, wherein the first chamber is disposed between the frangible member and the second chamber.

Example 8

The system of example 2 or any of examples 3-6, wherein the frangible member comprises a rupture disc.

Example 9

The system of example 2 or any of examples 3-6, wherein the frangible member comprises a shear pin.

Example 10

The system of example 1 or any of examples 2-9, wherein the fluid-flow restrictor comprises a vortex-inducing fluid-flow restrictor.

Example 11

The system of example 10, wherein the vortex-inducing fluid-flow restrictor comprises at least one arcuate vane.

Example 12

The system of example 10, wherein the vortex-inducing fluid-flow restrictor comprises a plurality of concentric arcuate vanes.

Example 13

The system of example 10, wherein the vortex-inducing fluid-flow restrictor comprises a plurality of arcuate vanes that are equidistant from an outlet of the fluid-flow restrictor.

Example 14

The system of example 1, or any of examples 2-13, wherein the fluid-flow restrictor comprises a shaped surface.

Example 15

The system of example 14, wherein the shaped surface comprises concentric square grooves.

Example 16

The system of example 14, wherein the shaped surface comprises concentric oscillatory grooves.

Example 17

The system of example 1, or any of examples 2-16, wherein the fluid-flow restrictor comprises an arcuate vane and a deflector.

Example 18

An apparatus to transmit fluid within a hydraulic tool, the apparatus comprising:

a first chamber, the first chamber being at a first pressure at a first time;

a second chamber, the second chamber being at a second pressure at the first time and at a third pressure at a second time, the first pressure being greater than the second pressure and approximately equal to the third pressure;

a fluid-flow path from the first chamber to the second chamber, the fluid-flow path comprising:

a fluid inlet to receive fluid into the fluid-flow path from the first chamber, a fluid outlet to deliver fluid to the second chamber from the fluid flow path, and at least one fluid-flow restrictor disposed between the fluid inlet and the fluid outlet to direct fluid received from the fluid inlet into a rotational flow path around a longitudinal axis of the fluid outlet.

Example 19

The apparatus of example 18, wherein the first chamber is a hydrostatic chamber.

Example 20

The apparatus of example 19, wherein the second chamber is an atmospheric chamber.

Example 21

The apparatus of example 20, wherein the fluid inlet is configured to introduce fluid received from the hydrostatic chamber along a direction tangential to the rotational flow path.

Example 22

The apparatus of example 20 or 21, wherein the fluid-flow restrictor comprises a plurality of guide vanes forming a vortex-inducing flow path.

Example 23

The apparatus of example 20 or any of examples 21-22, wherein the fluid-flow restrictor comprises at least one arcuate vane.

Example 24

The apparatus of example 20 or any of examples 21-23, wherein the fluid-flow restrictor comprises a plurality of concentric arcuate vanes.

Example 25

The apparatus of example 20 or any of examples 21-24, wherein the fluid-flow restrictor comprises a plurality of arcuate vanes that are equidistant from an outlet of the fluid-flow restrictor.

Example 26

The apparatus of example 20 or any of examples 21-25, wherein the fluid-flow restrictor comprises a shaped surface.

Example 27

The apparatus of example 26, wherein the shaped surface comprises concentric square grooves.

Example 28

The apparatus of example 26, wherein the shaped surface comprises concentric oscillatory grooves.

Example 29

The apparatus of example 18, or any of examples 19-28, wherein the fluid-flow restrictor comprises a vane and a deflector.

Example 30

The apparatus of example 18 or any of examples 19-29, wherein the fluid outlet is configured to collect fluid from a center of the vortex-inducing flow path.

Example 31

The apparatus of example 18 or any of examples 19-30, further comprising a frangible member, the frangible member configured to occlude flow through the fluid-flow path until a pressure of the hydraulic chamber reaches a predetermined threshold.

Example 32

The apparatus of example 31, wherein the frangible member comprises a rupture disc.

Example 33

The apparatus of example 31, wherein the frangible member comprises at least one shear pin.

Example 34

A method of actuating a hydraulic tool, the method comprising:

generating a hydrostatic pressure in a first chamber;

transmitting a fluid through a fluid-flow path from the first chamber to a second chamber, wherein the fluid-flow path comprises at least one vortex-inducing fluid-flow restrictor; and actuating the hydraulic tool by transmitting the hydrostatic pressure to the second chamber to generate a hydrostatic force against at least one movable member of the hydraulic tool.

Example 35

The method of example 34, further comprising breaking a frangible member using a fluid pressure in response to the hydrostatic pressure exceeding a threshold pressure, the frangible member being operable to occlude flow through the fluid-flow path until actuated.

Example 36

The method of example 34 or 35, wherein the hydraulic tool comprises a packer.

Example 37

The method of example 34 or 35, wherein the hydraulic tool comprises a bridge plug.

Example 38

The method of example 34 or 35, wherein the hydraulic tool comprises a high-expansion gauge hanger.

Example 39

The method of example 34 or 35, wherein the hydraulic tool comprises a cement retainer.

Example 40

The method of example 34 or any of examples 35-39, further comprising introducing fluid to a fluid inlet of the fluid-flow restrictor along a direction tangential to the fluid flow path, the fluid flow path being a generally rotational fluid flow path.

Example 41

The method of example 34 or any of examples 35-40, wherein the fluid-flow restrictor comprises a plurality of guide vanes forming a vortex-inducing flow path.

Example 42

The method of example 34 or any of examples 35-41, wherein the fluid-flow restrictor comprises at least one arcuate vane.

Example 43

The method of example 34 or any of examples 35-42, wherein the fluid-flow restrictor comprises a plurality of concentric arcuate vanes.

Example 44

The method of example 34 or any of examples 35-43, wherein the fluid-flow restrictor comprises a plurality of arcuate vanes that are equidistant from an outlet of the fluid-flow restrictor.

Example 45

The method of example 34 or any of examples 35-40, wherein the fluid-flow restrictor comprises a shaped surface.

Example 46

The method of example 45, wherein the shaped surface comprises concentric square grooves.

Example 47

The method of example 45, wherein the shaped surface comprises concentric oscillatory grooves.

Example 48

The method of example 34 or any of examples 35-47, wherein the fluid-flow restrictor comprises a vane and a deflector.

Example 49

The method of example 34 or any of examples 35-48, wherein the fluid outlet is configured to collect fluid from a center of the vortex-inducing flow path.

Example 50

The apparatus of example 18, wherein the at least one fluid-flow restrictor comprises a first fluid-flow restrictor and a second-fluid flow guide arranged in series, and wherein the first fluid-flow restrictor has an orientation that is opposite the orientation of the second fluid-flow restrictor, and.

Example 51

The apparatus of example 48, wherein the first fluid-flow restrictor and second fluid-flow restrictor are arranged in series provide the same flow restriction regardless of the direction of the flow.

It will be understood that the above description of the embodiments is given by way of example only and that various modifications may be made by those skilled in the art. The above specification, examples, and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

I claim:

1. A system to actuate a hydraulic tool, the system comprising:

a hydraulic conduit; and a hydraulic tool comprising:

a first chamber fluidly coupled to the hydraulic conduit, a second chamber that is expandable in response to a fluid flow, and the second chamber is separated from the first chamber by a fluid flow path comprising:

a rotational fluid-flow path from the first chamber to the second, the fluid-flow path containing a fluid-flow restrictor; and a frangible member in series with the fluid-flow restrictor, and the frangible member comprises a closed state in which fluid flow through the fluid-flow restrictor is prevented, and an open state in which fluid flow through the fluid-flow restrictor is permitted.

2. The system of claim 1, wherein the frangible member is positioned to prevent fluid flow from the first chamber to the second chamber when the frangible member is in an unactuated state and the frangible member is actuable to permit fluid flow from the first chamber to the second chamber when the frangible member is in an actuated state, wherein the frangible member is operable to automatically actuate when a pressure differential between the first chamber and the second chamber exceeds a predetermined threshold.

3. The system of claim 1, wherein the fluid-flow restrictor comprises a vortex-inducing fluid-flow restrictor.

4. The system of claim 3, wherein the vortex-inducing fluid-flow restrictor comprises at least one arcuate vane.

5. The system of claim 3, wherein the vortex-inducing fluid-flow restrictor comprises a plurality of concentric arcuate vanes.

6. The system of claim 3, wherein the vortex-inducing fluid-flow restrictor comprises a plurality of arcuate vanes that are equidistant from an outlet of the fluid-flow restrictor.

7. The system of claim 1, wherein the fluid-flow restrictor comprises a shaped surface.

8. An apparatus to transmit fluid within a hydraulic tool, the apparatus comprising:

a first chamber, the first chamber being at a first pressure at a first time;

a second chamber expandable in response to an increase in pressure, the second chamber being at a second pressure at the first time and at a third pressure at a second time, the first pressure being greater than the second pressure and approximately equal to the third pressure;

a fluid-flow path from the first chamber to the second chamber, the fluid-flow path comprising:

a fluid inlet to receive fluid into the fluid-flow path from the first chamber, a fluid outlet to deliver fluid to the second chamber from the fluid flow path, at least one fluid-flow restrictor disposed between the fluid inlet and the fluid outlet to direct fluid received from the fluid inlet into a rotational flow path around a longitudinal axis of the fluid outlet; and a frangible member in series with the fluid-flow restrictor, and the frangible member comprises a closed state in which fluid flow through the fluid-flow restrictor is prevented, and an open state in which fluid flow through the fluid-flow restrictor is permitted.

9. The apparatus of claim 8, wherein the fluid inlet is configured to introduce fluid received from the first chamber along a direction tangential to the rotational flow path.

10. The apparatus of claim 8, wherein the fluid-flow restrictor comprises a plurality of guide vanes forming a vortex-inducing flow path.

11. The apparatus of claim 8, wherein the fluid-flow restrictor comprises at least one arcuate vane.

12. The apparatus of claim 8, wherein the fluid-flow restrictor comprises a plurality of arcuate vanes that are equidistant from an outlet of the fluid-flow restrictor.

13. The apparatus of claim 8, wherein the fluid-flow restrictor comprises a shaped surface.

14. The apparatus of claim 13, wherein the shaped surface comprises concentric square grooves.

15. The apparatus of claim 13, wherein the shaped surface comprises concentric oscillatory grooves.

16. The apparatus of claim 8, wherein the fluid-flow restrictor comprises a vane and a deflector.

17. A method of actuating a hydraulic tool, the method comprising:

generating a hydrostatic pressure in a first chamber;

transmitting a fluid through a fluid-flow path from the first chamber to a second chamber, wherein the fluid-flow path comprises at least one vortex-inducing fluid-flow restrictor a frangible member in series with the fluid-flow restrictor, and the frangible member comprises a closed state in which fluid flow through the fluid-flow restrictor is prevented, and an open state in which fluid flow through the fluid-flow restrictor is permitted; and actuating the hydraulic tool by transmitting the hydrostatic pressure to the second chamber to expand the second chamber and to generate a hydrostatic force against at least one movable member of the hydraulic tool.

18. The method of claim 17, further comprising introducing fluid to a fluid inlet of the fluid-flow restrictor along a direction tangential to the fluid flow path, the fluid flow path being a generally rotational fluid flow path.

19. The method of claim 17, wherein the fluid-flow restrictor comprises a plurality of guide vanes forming a vortex-inducing flow path.

20. The method of claim 17, wherein the fluid-flow restrictor is operable to restrict the flow of fluid by a variable amount depending on the flow rate of the fluid.

* * * * *